United States Patent [19]

Kirsch

[11] 4,160,934

[45] Jul. 10, 1979

[54] CURRENT CONTROL CIRCUIT FOR LIGHT EMITTING DIODE

[75] Inventor: Howard C. Kirsch, Emmaus, Pa.

[73] Assignee: Bell Telephone Laboratories, Incorporated, Murray Hill, N.J.

[21] Appl. No.: 823,729

[22] Filed: Aug. 11, 1977

[51] Int. Cl.[2] ..... G05F 1/56; H05B 43/00

[52] U.S. Cl. ..... 315/307; 307/251; 307/297; 323/22 T; 340/333

[58] Field of Search ..... 315/291, 307, 169 R, 315/169 TV; 307/311, 251, 297, 304; 340/324 R, 333, 336; 323/4, 22 T

[56] References Cited

U.S. PATENT DOCUMENTS

| | | | |
|---|---|---|---|
| 3,736,522 | 5/1973 | Padgett | 307/251 X |
| 3,925,690 | 12/1975 | Spence | 340/336 X |
| 3,955,103 | 5/1976 | Russell et al. | 307/297 X |
| 4,017,847 | 4/1977 | Burford et al. | 340/336 |

*Primary Examiner*—Eugene R. La Roche

[57] ABSTRACT

The current in a semiconductive light emitting diode (LED), driven by an insulated gate field effect transistor (IGFET) switch, is stabilized by a current control circuit including a comparator type feedback network, which stabilizes the voltage at a node located between said switch and the series connection of a ballast resistor and the LED.

12 Claims, 1 Drawing Figure

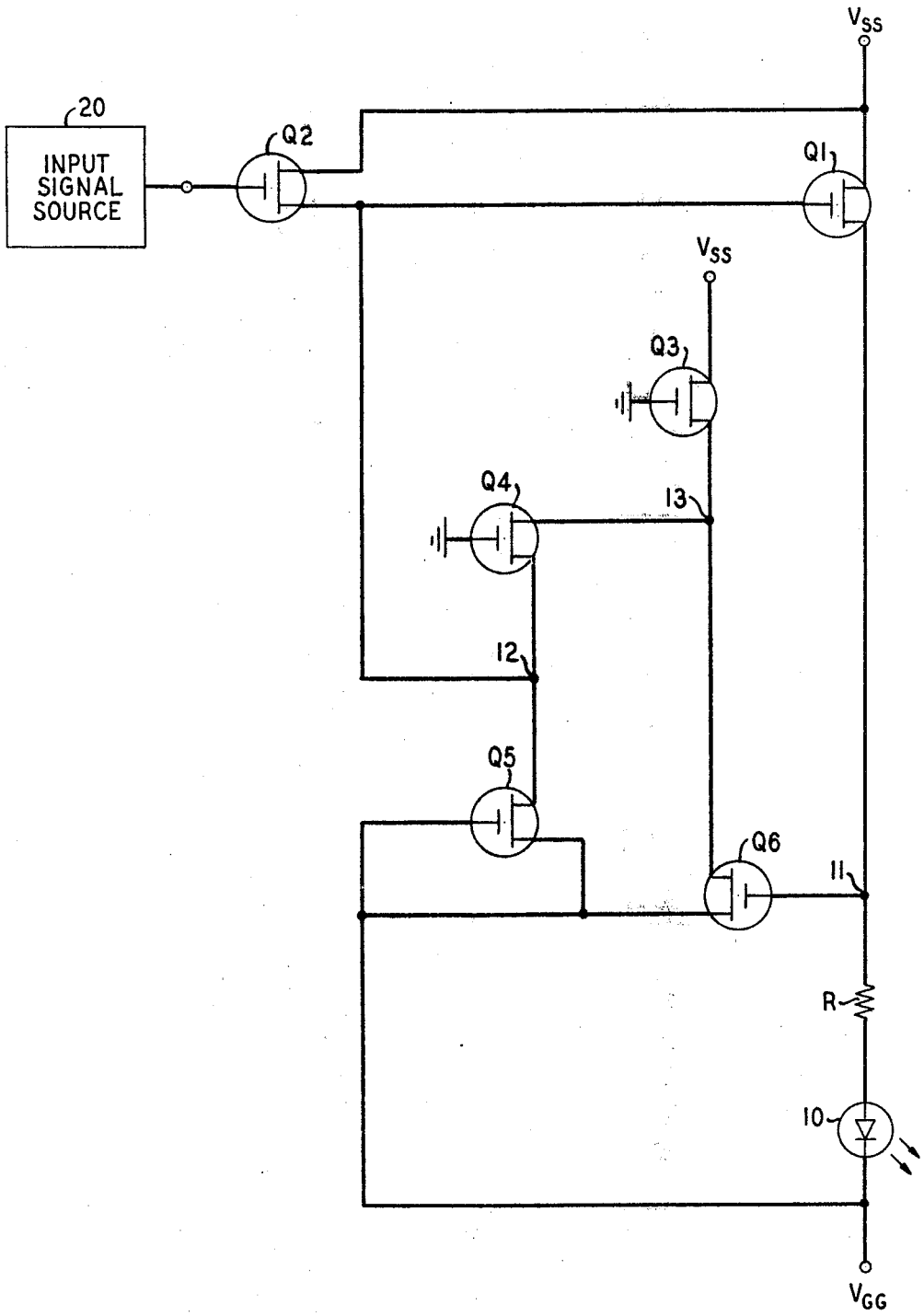
20
INPUT SIGNAL SOURCE
Q2
Q1
$V_{SS}$
$V_{SS}$
Q3
Q4
13
12
Q5
Q6
11
R
10
$V_{GG}$

CURRENT CONTROL CIRCUIT FOR LIGHT EMITTING DIODE

FIELD OF THE INVENTION

This invention relates to the field of semiconductor apparatus, and more particularly to semiconductor circuits for controlling light emitting diodes.

BACKGROUND OF THE INVENTION

In the prior art, the current in a semiconductor light emitting diode (LED) has been regulated by a control circuit containing an insulated gate field effect transistor (IGFET) driver switch of relatively very large transconductance in series with a ballast resistor. The IGFET driver is typically formed in a semiconductive silicon chip in accordance with standard MOS (metal-oxide-semiconductor) technology. During operation, if the voltage drop across the IGFET driver in its "on" condition is relatively small compared with applied voltage, the brightness of the LED in its "on" condition is somewhat stabilized by the ballast resistor. However, such a control circuit suffers from poor current regulation, whereby the current in the LED during operation can fluctuate by as much as a factor of 3 when the voltage of the external power supply, of typically about 5 or 6 volts, fluctuates by only 20 percent. Although this fluctuation in current can be reduced by means of the selection of larger voltages for the power supply in conjunction with a larger ballast resistor, such an approach to the current fluctuation problem still suffers from the requirement of a physically relatively large IGFET driver, which consumes an undesirably large amount of semiconductive silicon chip area, but which is required in order to keep the driver resistance, and hence the driver voltage drop, relatively small (0.5 volt drop) for the desired LED operating current. Moreover, ordinary processing variations in the manufacture of the IGFET driver of the prior art circuit cause corresponding variations in the LED operating current, thereby adversely affecting either the brightness or the lifetime of the LED on account of, respectively, either too little or too much operating current. It would therefore be desirable to have a control circuit for stabilizing the operating current in an LED, which mitigates the shortcomings of the prior art.

SUMMARY OF THE INVENTION

The current in an LED is stabilized by a control circuit which includes an IGFET driver switch, connected together with a comparator type feedback control network for stabilizing the voltage at a node of the series circuit of a ballast resistor in series with the LED and the IGFET driver. During operation, the voltage at the node remains essentially at a reference potential controlling the feedback network. By reason of this comparator feedback network technique, the IGFET driver switch in the circuit of this invention can operate with a relatively large source-drain voltage, typically of about 5 volts; therefore, for a given operating current in the thereby controlled LED, the IGFET driver can now have a relatively high resistance, thereby reducing the required amount of semiconductor chip area therefor.

In a specific embodiment of the invention, an LED is connected in series with a ballast resistor and the high current path (source-drain) of an IGFET driver switch ($Q_1$). The node between the IGFET driver and the series connection of the LED and ballast resistor is connected through a comparator type feedback network back to the low current control (gate) terminal of the IGFET driver. This control terminal of the IGFET driver is also connected through the high current path of an auxiliary control IGFET ($Q_2$) switch to a voltage source, the low current control terminal of this auxiliary IGFET being connected to an input terminal for application thereto of input signals to turn the LED "on" and "off".

BRIEF DESCRIPTION OF THE DRAWING

This invention together with its features, objects, and advantages can be better understood from the following detailed description when read in conjunction with the drawing in which the FIGURE is a schematic circuit diagram of a control circuit for regulating the current in a semiconductor LED in accordance with a specific embodiment of the invention.

DETAILED DESCRIPTION

As shown in the FIGURE, a semiconductor LED 10 has one of its terminals connected to a voltage source $V_{GG}$ and another of its terminals connected to a ballast resistor R. Only for the sake of definiteness, the circuit parameters will be described in terms of P-MOS technology. Typically, the source $V_{GG}$ is approximately $-12$ volts, and the resistor R is approximately a thousand ohms. The LED is characterized by an operating "on" current of about 10 milliamperes with an operating voltage drop of about 2 to 3 volts. The LED and the resistor R are connected in series with the high currrent path of an IGFET driver $Q_1$ to another voltage source $V_{SS}$ of about $+5$ volt. In its "on" state, the driver $Q_1$ has a resistance advantageously equal to about R/2 or less.

As further shown in the FIGURE, the IGFETs $Q_3$, $Q_4$, $Q_5$ and $Q_6$ are in a comparator feedback network arrangement for stabilizing the voltage at node 11 located between R and $Q_1$. For this purpose, the node 11 is connected to a low current (gate) terminal of $Q_6$ whose high current path connects $V_{GG}$ to a node 13. The node 13 is connected to $V_{SS}$ through the high current path of $Q_3$ whose gate terminal is grounded ($V=0$). The gate terminal of the driver $Q_1$ is connected to a node 12 which is connected through $Q_5$ to $V_{GG}$ and through $Q_4$ to the node 13. The IGFET $Q_5$ is in a diode configuration; that is, the drain and gate terminals of $Q_5$ are shorted together, so that $Q_5$ behaves as a diode which tends to conduct current only in the direction toward the source $V_{GG}$. On the other hand, the gate terminal of $Q_4$ is connected to ground serving as a reference potential.

The node 12 is further connected to $V_{SS}$ through the high current path of $Q_2$. The gate of $Q_2$ is connected to an input signal source 20 which provides signals for turning $Q_2$ "on" and "off". As more fully explained below, when $Q_2$ is "on", then $Q_1$ is "off" and hence the LED 10 is also "off"; and when $Q_2$ is "off", the $Q_1$ is "on" and hence the LED 10 is also "on". Thus, the feedback arrangement acts as a signal inverter as well as a current stabilizer.

To ensure proper operation, it is important that the transconductance ratios $B_2$, $B_3$, $B_4$, $B_5$, and $B_6$ of the IGFETs $Q_2$, $Q_3$, $Q_4$, $Q_5$, and $Q_6$, respectively, should satisfy the following: $B_5$ should be much less than $B_3$; $B_3$ should be much less than either of $B_4$ and $B_6$; and both $B_4$ and $B_6$ should be much less than $B_2$. By "much less than" is meant less than by preferably at least an order of magnitude, but in any event at least by a factor of 2 or 5. For example, by way of an illustrative example only, suitable approximate values for the B's are: $B_5=2\times10^{-6}$ mho/V; $B_3=15\times10^{-6}$ mho/V; $B_4=B_6=100\times10^{-6}$ mho/V; and $B_2=250\times10^{-6}$ mho/V. Moreover, the transistor $Q_1$ is advantageously characterized by moderately high $B_1$; for a 10 milliamp LED current, a suitable approximate value is $B_1=250\times10^{-6}$ mho/volt. In the absence of the comparator feedback circuit, the required transconductance of the IGFET driver would be about $1{,}200\times10^{-6}$ mho/volt.

Operation of the circuit shown in the Figure can be understood from the following considerations. Starting from a condition in which the LED and the driver $Q_1$ are both "off" in the presence of a signal from the source 20 sufficient to maintain $Q_2$ in its "on" state, it will first be shown that this condition is stable; and it will then be shown that a signal applied thereafter that is sufficient to switch and maintain $Q_2$ in its "off" state will then switch and maintain both the driver $Q_1$ and the LED "on" in a stabilized current condition. In order to explain this operation, it is to be noted that when at first the input signal maintains $Q_2$ in its "on" state, then the driver $Q_1$ will thus be in its "off" state and hence the LED will also be in its "off" state. Under these conditions, the node 12 tends to remain at essentially the potential $V_{SS}$ both by virtue of the connection of this node to the source $V_{SS}$ through the relatively high B IGFET $Q_2$ directly to the source voltage $V_{SS}$, and this connection is thus through the transistor of the highest B as compared with those of all others ($Q_3$, $Q_5$, and $Q_6$ in particular). Thus, the node 12 remains in a stable condition at essentially $V_{SS}$ (the substrate of all transistors being connected to $V_{SS}$ as ordinarily in P-MOS integrated circuits). Accordingly, the voltage on the node 12 maintains the IGFET $Q_1$ in its "off" state, thereby maintaining the LED 10 in its "off" state also. Meanwhile, since the node 11 is essentially at potential at $V_{GG}$ due to the path through R and the LED to the source $V_{GG}$, the transistor $Q_6$ is in its "on" state; so that the node 13 is essentially at potential $V_{GG}$ (except for a threshold of $Q_6$ which, with the backgate bias effect, is about $-5$ or $-6$ volts) even though $Q_3$ is also "on", because of the high $B_6$ of $Q_6$ as compared with the low $B_3$ of $Q_3$. On the other hand, since this node 13 is at essentially $V_{GG}$ while the node 12 is at $V_{SS}$, $Q_4$ is "on"; but this "on" condition of $Q_4$ combined with the "on" conditions of $Q_5$ and $Q_6$ is not sufficient to pull the node 12 away from $V_{SS}$, since $Q_2$ has the highest transconductance B of all. Thus, the node 12 remains stably at $V_{SS}$, thereby keeping $Q_1$ in its "off" state and hence the LED stably remains in its "off" state also.

When the input signal applied by the source 20 to the gate of $Q_2$ is then switched to a value sufficient to turn $Q_2$ "off", the potential of the node 12 tends toward $V_{GG}$ but without reaching it because the driver $Q_1$ turns "on" before this node 12 reaches ground. As soon as the driver $Q_1$ turns "on", however, the LED turns "on" also and the node 11, between $Q_1$ and R, goes from the potential $V_{GG}$ toward the potential $V_{SS}$, since the on resistance of the driver is advantageously made sufficiently small compared with R, typically about R/2. As the node 11 goes toward $V_{SS}$, the transistor $Q_6$ allows the node 13 to go toward $V_{SS}$ by virtue of the "on" state of $Q_3$. But when this node 13 reaches ground plus the threshold of $Q_4$, then $Q_4$ itself turns "on" with node 13 acting as its source and node 12 as its drain, thereby preventing the node 12 from going any further toward $V_{GG}$. In this way, the node 12 is kept at a potential suitable for maintaining the driver $Q_1$ and the LED in their "on" states. In effect, the transistor arrangement of $Q_3$, $Q_4$, $Q_5$, and $Q_6$ acts as a feedback comparator for stabilizing, against fluctuations of either polarity, the voltage at node 11 essentially at the voltage applied to the gate of $Q_4$, whenever the signal input turns $Q_2$ "off". Thus, the LED remains "on" until the input signal is thereafter switched to a value sufficient to turn the transistor $Q_2$ back to its "on" state.

Although the invention has been described in detail in terms of a specific embodiment, various modifications can be made without departing from the scope thereof. For example, N-MOS technology can be used instead of P-MOS, that is, all the transistors $Q_1$–$Q_6$ can be integrated in a P-type semiconductor chip with N+ type source and drain regions, with suitable modifications in $V_{SS}$ and $V_{GG}$. Moreover, other types of transistors than IGFETs can be used, such as J-FETS or bipolar transistors. Also, a unidirectional current inhibiting diode element of conductance $B_5$ in the forward direction can be used instead of the transistor $Q_5$. Moreover, the voltages applied to gate electrode of $Q_4$ and of $Q_3$ can both be other than ground, in order to stabilize the voltage at node 11 during operation at a corresponding voltage other than essentially ground potential. In any event, however, it is important that the voltage difference ($V_{SS}$–$V_{GG}$) be at least three or more times the voltage drop across the LED in its "on" state, and that the voltage at node 11 be stabilized to a value that is sufficiently different from $V_{SS}$ to enable the use of a relatively small sized driver $Q_1$ of relatively high resistance, thereby to conserve semiconductor chip area.

What is claimed is:

1. Semiconductor apparatus which comprises:

(a) a first transistor drive having a high current carrying terminal connected to an output terminal;

(b) a comparator feedback control network including first and second feedback terminals and fourth and sixth transistors each having a pair of high current carrying terminals and a low current carrying terminal, the first feedback terminal connected to a low current carrying control terminal of said first transistor driver and the second feedback terminal connected to said high current carrying terminal, said second feedback terminal for connection thereto of a controlled device, one of the high current carrying terminals of the fourth transistor being connected to one of the high current carrying terminals of the sixth transistor, the low current carrying terminal of the sixth transistor being connected to the second feedback terminal, and the other of the high current carrying terminals of the fourth transistor being connected to the first feedback terminal, the low current carrying terminal of the fourth transistor being connectd to a terminal for the application thereto of a reference potential; and (c) input signal means, operative on the first feedback terminal, for maintaining said driver in its "off" state in response to a first input from said signal means during operation and for enabling said driver to turn "on" in response to a second input from said signal means during operation.

2. Apparatus according to claim 1 in which said input signal means includes a second transistor one of whose high current carrying terminals is connected to the first feedback terminal.

3. Apparatus according to claiam 1 in which the first feedback terminal is connected through a unidirectional current inhibiting device to the other high current carrying terminals of the sixth transistor, and in which the said one high current carrying terminal of the fourth transistor is connected through the high current path of a third transistor to a terminal for the application thereto of a voltage source.

4. Apparatus according to claim 3 in which the transconductance of the third transistor is less than those of both the fourth and sixth transistors.

5. Apparatus according to claim 4 in which the unidirectional current inhibiting device is a fifth transistor one of whose high current carrying terminals is connected to its low current carrying terminals and in which the transconductance of the fifth transistor is less than that of the third transistor, the transconductance of the second transistor being greater than those of both the fourth and sixth transistors.

6. Apparatus according to claim 5 in which the first, second, fourth and fifth transistors are insulated gate field effect transistors.

7. Semiconductor apparatus comprising:

(a) a first transistor having a low current carrying terminal and a pair of high current carrying terminals, one of said high current carrying terminals being connected to an output terminal to which is connected a light emitting diode in series with a ballast resistor;

(b) a second transistor having a low current carrying terminal for connection thereto of an input signal source and having a pair of high current carrying terminals, one of the said high current carrying terminals of the second transistor being connected to the said low current carrying terminal of the first transistor;

(c) third, fourth, and sixth transistors each having a low current carrying terminal and a pair of high current carrying terminals;

(d) means for connecting mutually together one of the high current carrying terminals of each of the third, fourth, and sixth transistors;

(e) a fifth unidirectional current inhibiting transistor device connected between the other high current carrying terminals of the fourth and sixth transistors; and (f) means for connecting the said other high current carrying terminal of the fourth transistor to said one of the high current carrying terminals of the second transistor; said first, second, third, fourth, fifth, and sixth transistors being MOS transistors characterized in that the transconductance of the fifth transistor is less than that of the third transistor, the trnasconductance of the third transistor is less than those of both the fourth and the sixth transistors, and the transconductances of both the fourth and sixth transistors are less than that of the second transistor.

8. Semiconductor apparatus comprising:

(a) a first transistor having a low current carrying terminal and a pair of high current carrying terminals, one of said high current carrying terminals being connected to an output terminal for connection thereto of a light emitting diode in series with a ballast resistor;

(b) a second transistor having a low current carrying terminal for connection thereto of an input signal source and having a pair of high current carrying terminals, one of the said high current carrying terminals of the second transistor being connected to the said low current carrying terminal of the first transistor;

(c) third, fourth, and sixth transistors each having a low current carrying terminal and a pair of high current carrying terminals;

(d) means for connecting mutually together one of the high current carrying terminals of each of the third, fourth, and sixth transistors;

(e) a fifth unidirectional current inhibiting device connected between the other high current carrying terminals of the fourth and sixth transistors;

(f) means for connecting the said other high current carrying terminal of the fourth transistor to said one of the high current carrying terminals of the second transistor; and (g) means for connecting the low current carrying terminals of the third and fourth transistors to terminals for the application thereto of reference potentials.

9. Apparatus according to claim 8 in which the other high current carrying terminals of the second and third transistors are connected to terminals for connection thereto of a first voltage source, and the other high current carrying terminal of the sixth transistor is connected to terminals for connection thereto of a second, different voltage source.

10. Apparatus according to claim 9 in which the first, second, third, fourth and sixth transistors are insulated gate field effect transistors and in which the fifth current inhibiting device is a field effect transistor whose gate terminal is shorted to its drain terminal.

11. Apparatus according to claim 9 in which said light emitting diode is connected in series with said ballast resistor to a terminal for connection thereto of a third voltage source.

12. Apparatus according to claim 11 in which the terminals for connection thereto of said second and third voltage sources are one and the same terminals.

* * * * *

UNITED STATES PATENT AND TRADEMARK OFFICE

CERTIFICATE OF CORRECTION

PATENT NO. : 4,160,934
DATED : July 10, 1979
INVENTOR(S) : Howard C. Kirsch

It is certified that error appears in the above-identified patent and that said Letters Patent are hereby corrected as shown below:

Column 4, line 38, "drive" should read --driver--.
Column 4, line 58, "connectd" should read --connected--.
Column 5, line 3, "claiam" should read --claim--.
Column 5, line 56, "trnasconductance" should read --transconductance--.

Signed and Sealed this

*Thirtieth* Day of *October 1979*

[SEAL]

*Attest:*

RUTH C. MASON
*Attesting Officer*

LUTRELLE F. PARKER
*Acting Commissioner of Patents and Trademarks*